US008167026B2

(12) United States Patent
Bergmiller et al.

(10) Patent No.: US 8,167,026 B2
(45) Date of Patent: May 1, 2012

(54) COLLECTOR TANK FOR A MULTI-ROW HEAT EXCHANGER

(75) Inventors: Jörg Bergmiller, Ostfildern (DE); Thomas Seeger, Leinfelden-Echterdingen (DE)

(73) Assignee: Behr Industry GmbH & Co. KG, Stuttgart (DE)

( * ) Notice: Subject to any disclaimer, the term of this patent is extended or adjusted under 35 U.S.C. 154(b) by 1099 days.

(21) Appl. No.: 11/569,662

(22) PCT Filed: May 27, 2005

(86) PCT No.: PCT/EP2005/005759

§ 371 (c)(1),
(2), (4) Date: Aug. 24, 2007

(87) PCT Pub. No.: WO2005/116561

PCT Pub. Date: Dec. 8, 2005

(65) Prior Publication Data

US 2008/0223553 A1 Sep. 18, 2008

(30) Foreign Application Priority Data

May 28, 2004 (DE) ..... 10 2004 026 688

(51) Int. Cl.
*B60H 1/00* (2006.01)

(52) U.S. Cl. ..... 165/41; 165/76; 165/173; 165/176

(58) Field of Classification Search ..... 165/41, 165/76, 173, 176
See application file for complete search history.

(56) References Cited

U.S. PATENT DOCUMENTS

| | | | | |
|---|---|---|---|---|
| 5,295,532 | A * | 3/1994 | Hughes | 165/76 |
| 6,749,015 | B2 | 6/2004 | Moreau | |
| 7,121,332 | B2 | 10/2006 | Förster et al. | |
| 2003/0159813 | A1 | 8/2003 | Baldantoni | |

FOREIGN PATENT DOCUMENTS

| | | | |
|---|---|---|---|
| DE | 91 11 412 | U1 | 12/1991 |
| DE | 102 55 487 | A1 | 6/2004 |
| GB | 598771 | A | 2/1948 |
| GB | 724017 | A | 2/1955 |
| GB | 1 303 040 | A | 1/1973 |
| GB | 2 082 312 | A | 3/1982 |
| JP | 63-280966 | A | 11/1988 |
| JP | 3-260597 | A | 11/1991 |
| JP | 9-126680 | A | 5/1997 |

* cited by examiner

*Primary Examiner* — Ljiljana Ciric
(74) *Attorney, Agent, or Firm* — Foley & Lardner LLP

(57) ABSTRACT

A collector tank for a heat exchanger of an automotive cooling system includes a one-piece tank element comprising a first collecting region and a second collecting region, wherein at least one of the first collecting region and the second collecting region comprises a projection; a base that closes off the collecting regions of the tank element, the base comprising at least one channel; a sealing element disposed within the at least one channel; and a stress generating means located adjacent to the channel and clamping at least a portion of the one-piece tank element to the base such that the sealing element is compressed between the projection and the base within the channel. The stress generating means is a means selected from the group consisting of a tensile stress generating means, a compressive stress generating means, and a combination thereof.

18 Claims, 10 Drawing Sheets

COLLECTOR TANK FOR A MULTI-ROW HEAT EXCHANGER

Figure 1:
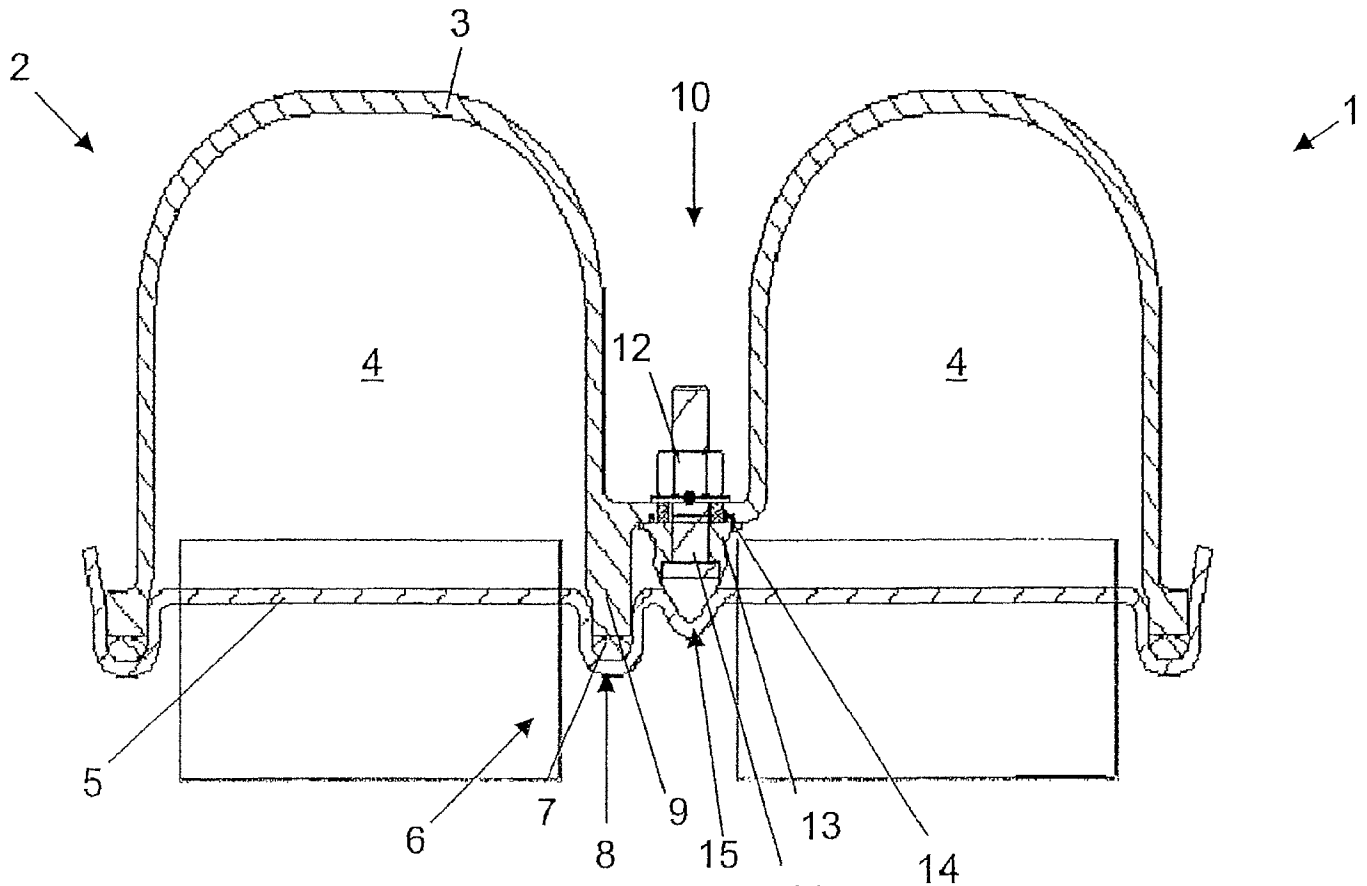

The invention relates to a collecting tank for a multi-row heat exchanger.

In conventional collecting tanks for multi-row coolers, in particular for motor vehicle cooling systems, comprising a tank element, which has at least two regions, referred to in the following as collecting regions, which are connected to one another in one piece and hold fluid, and comprising a substantially planar base which closes off said collecting regions, leakage problems occur, in particular in cost-effective plastic collecting tanks, between the individual adjacent collecting regions of the collecting tanks. Leakage is, however, undesired, in particular where different circuits, if appropriate operating with different media or at different temperatures, are arranged adjacent to one another in the collecting tank. As a result of the leakage problems, aluminum collecting tanks are used, which are produced by means of pressure die casting and are considerably more expensive.

It is an object of the invention to provide an improved collecting tank for a multi-row heat exchanger. Said improved collecting tank should preferably be cost-effective to produce.

According to the invention, a collecting tank is provided which has at least one tensile stress generating means and/or a correspondingly acting compressive stress generating means which ensures that the sealing arrangement, preferably formed by a flat seal or cord seal, which is arranged between the tank element and the base is sufficiently pressed in between the tank element and the base and therefore fulfils its function, that is to say reliably prevents leakage from one collecting region into the adjacent collecting region, even at high pressures.

The tensile stress generating means or the compressive stress generating means is preferably formed in at least two parts, preferably in three parts, and preferably comprises at least one threaded connection for adjusting the applied tensile stress or a clip-type connection for a simple and fast connection between the base and the tank element.

According to one embodiment, a part of the tensile stress generating means can be fixedly connected to the base or to the tank element, and can extend through the tank element or through the base in the region of an opening, said part having a thread at least in one part of the outwardly protruding region, with an element, in particular a nut, which is provided with a thread which interacts with said thread, being screwed onto said thread from the outside as a second part of the tensile stress generating means. Here, to simplify production, that part of the tensile stress generating means which is fixedly connected to the base or to the tank element is formed as a strip and has a plurality of openings in which screws or threaded bolts can be fastened so as to be rotationally fixed.

According to an alternative embodiment, a part, which has an inner thread, of the tensile stress generating means can be fixedly connected to the base or to the tank element, and the tank element or the base has an opening through which an element which has an outer thread extends, said element being screwed into the inner thread. In this case as well, that part of the tensile stress generating means which is fixedly connected to the base or to the tank element is formed as a strip and has a plurality of openings having an inner thread.

The tensile stress generating means which, in a corresponding embodiment, can also be arranged in an edge region of a collecting region, has at least one sealing element for the purpose of providing sealing with respect to the environment.

In the case of an embodiment of the tensile stress generating means as a clip-type connection, preferably as a plurality of clip-type connections arranged in a row, at least one resilient arm is preferably formed or provided on, in particular injection-molded into, the tank element or the base, said resilient arm engaging in an opening in the base or in the tank element. This allows simple and very fast assembly. The plurality of openings are preferably each circular or slot-shaped.

If the tensile stress generating means or the compressive stress generating means is arranged centrally between two collecting regions, one sealing arrangement is preferably provided at each side of said means.

The sealing arrangement preferably has a sealing element which corresponds to the sealing elements used on the outsides of the collecting tank, so that it is not possible to incorrectly exchange seals during assembly, and the production costs can be reduced as a result of the relatively large unit numbers, and the storage costs can be reduced as a result of the relatively low number of different parts. It is also possible here for a plurality of sealing elements to be provided.

It is preferable for a channel to be formed in the base, with the sealing element being inserted in said channel, and for a face which corresponds approximately to the width of the channel to be provided on the tank element, said face bearing at least partially against the sealing element, so that a sufficient compressive stress can be exerted on the sealing element without the latter being damaged. It alternatively possible for a channel to be formed in the tank element, with the sealing element being placed in said channel, and for a face which corresponds approximately to the width of the channel to be provided on the base, said face bearing at least partially against the sealing element. The face is preferably formed as a projection which extends in the longitudinal direction of the collecting tank in the direction of the base or of the tank element.

The collecting tank is preferably used as a heat exchanger, in particular cooler, of a motor vehicle cooling system.

It is self-evident that the invention relates not only to plastic collecting tanks but also to collecting tanks made from other materials, such as in particular aluminum. Through the provision of a tensile stress generating means or compressive stress generating means according to the invention, it is possible for plastic or metal collecting tanks to be formed, for example, with a slightly reduced wall thickness, or for relatively high pressures to be used. In this case, it is also possible in particular for a soldered or if appropriate welded connection to be provided instead of a connection by means of adhesive. The selected connection is dependent on the materials to be connected, the expected loads, in particular the expected temperatures and stresses, and the costs for the connection.

Figure 2:
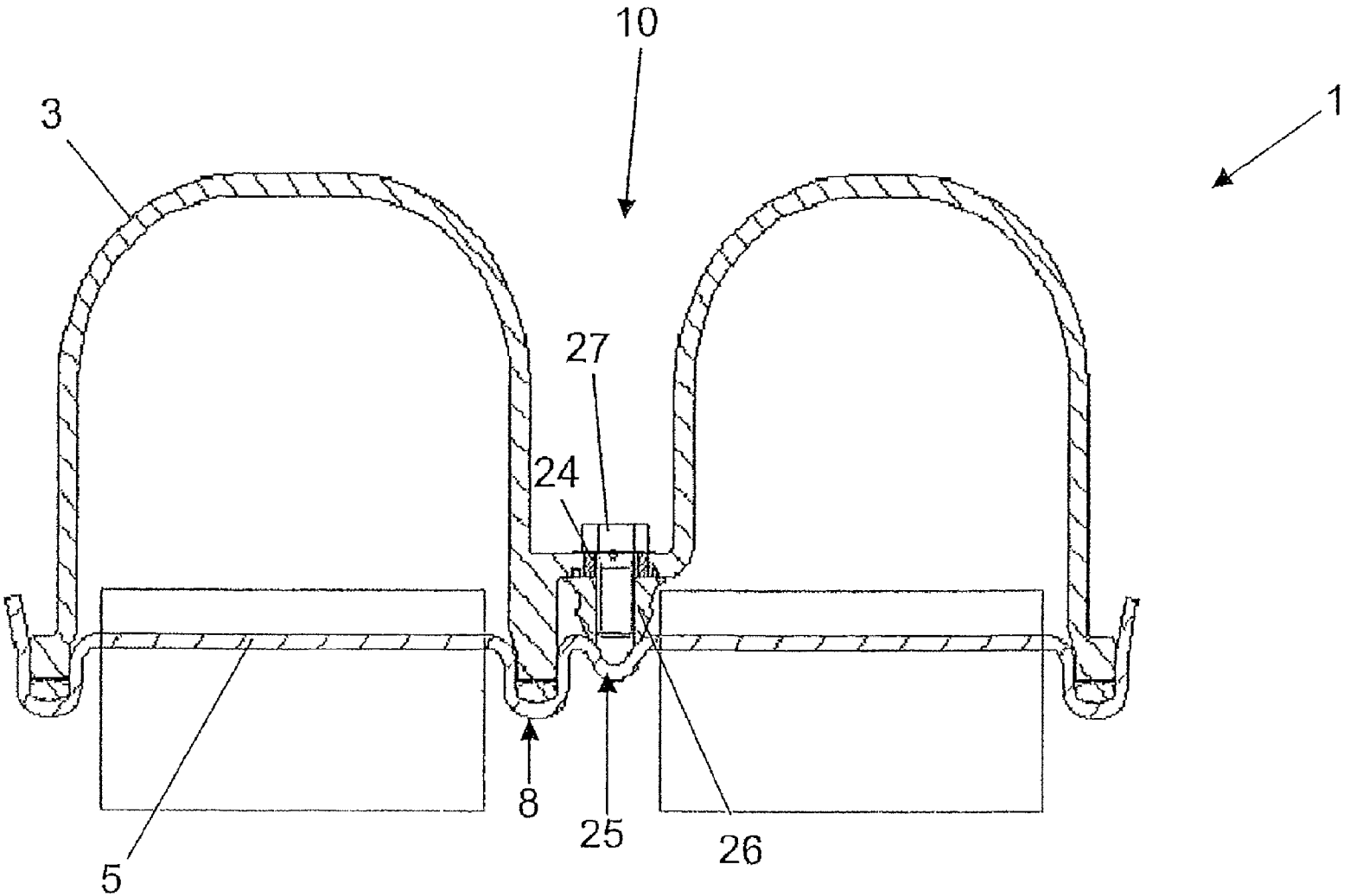
Figure 3:
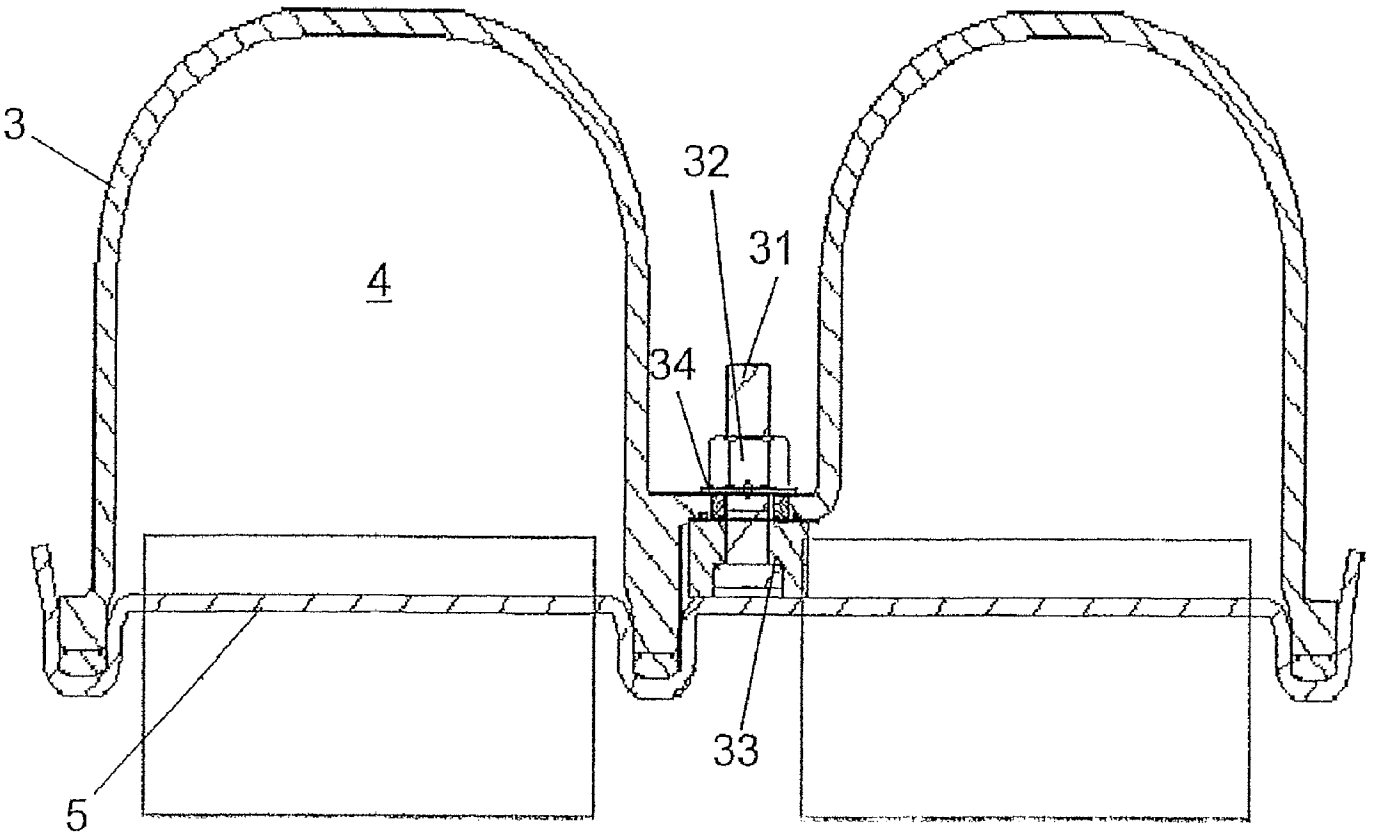
Figure 4:
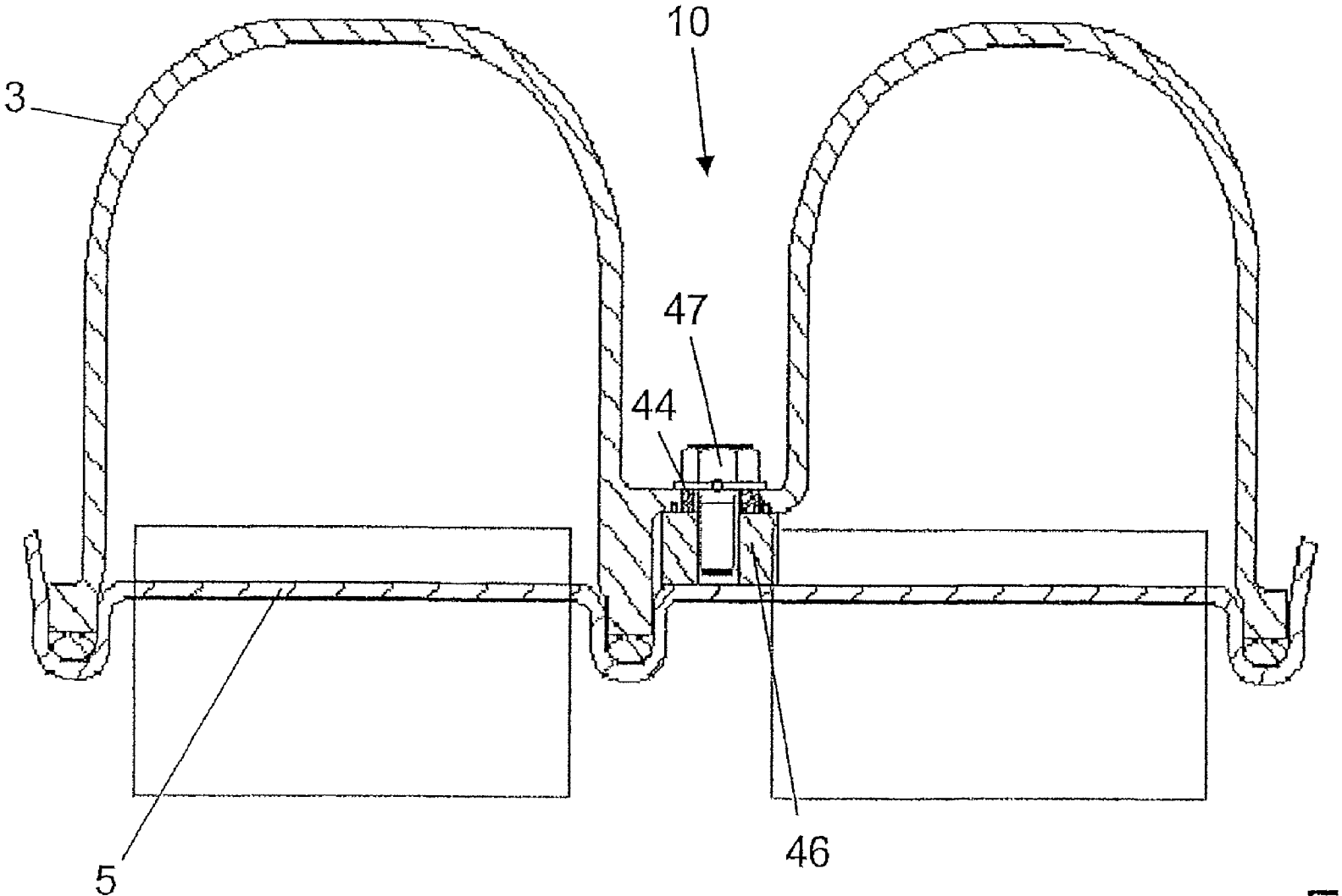
Figure 5:
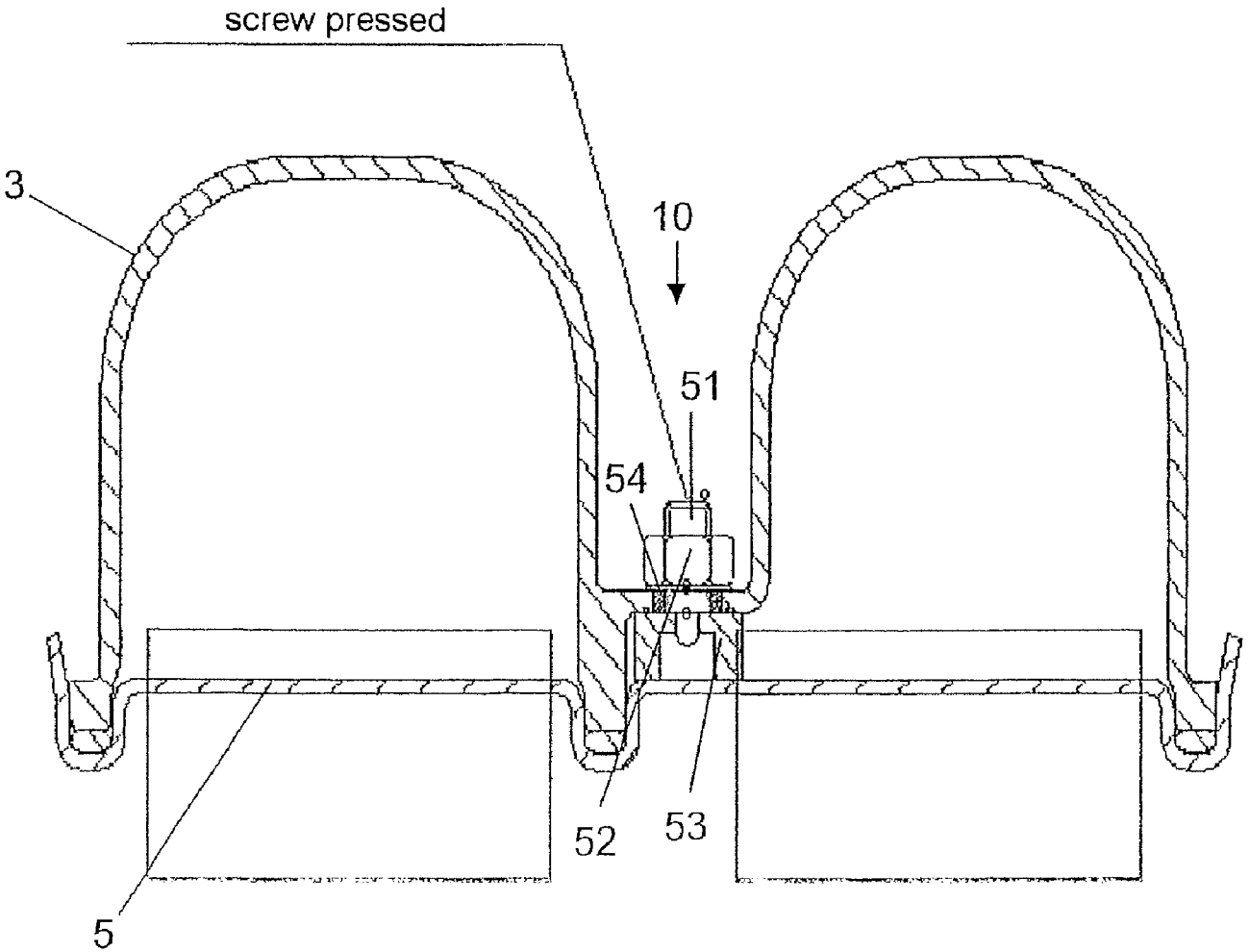
Figure 6A:
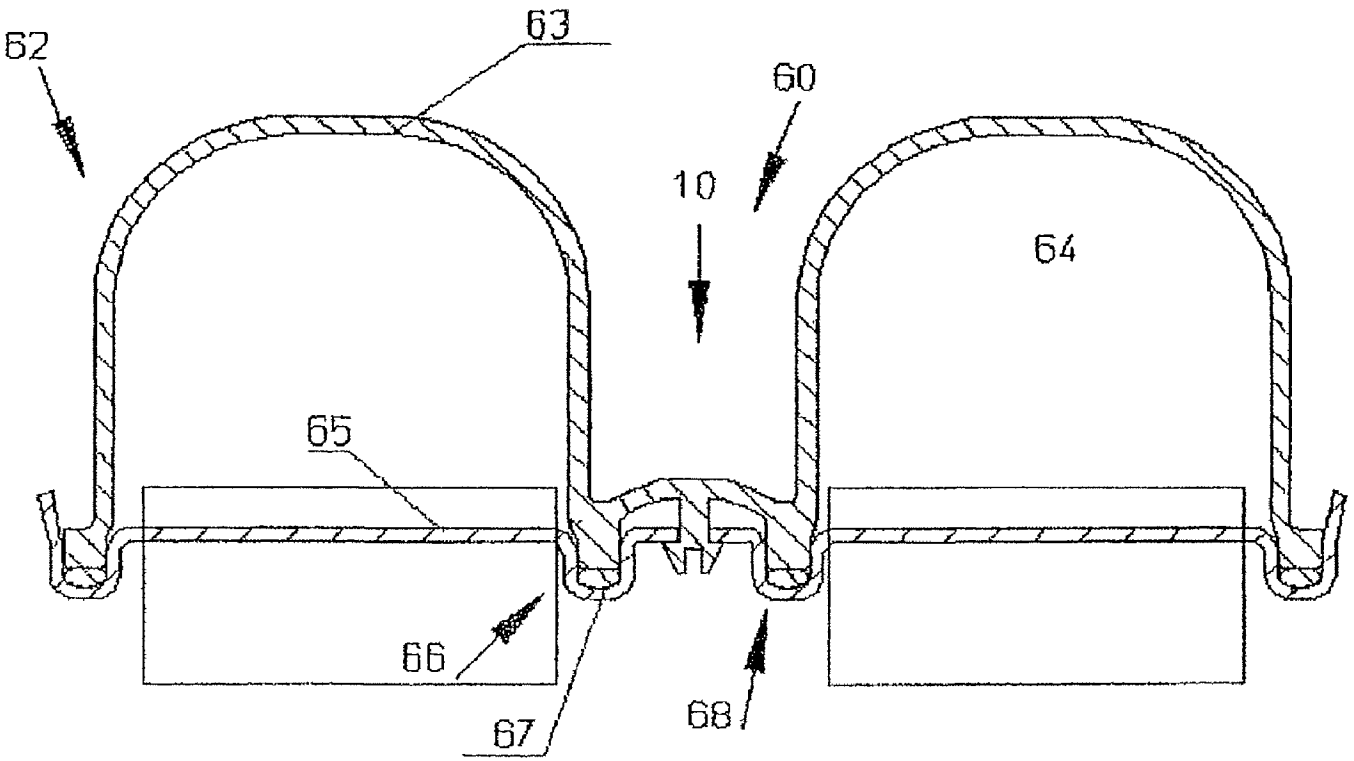
Figure 6B:
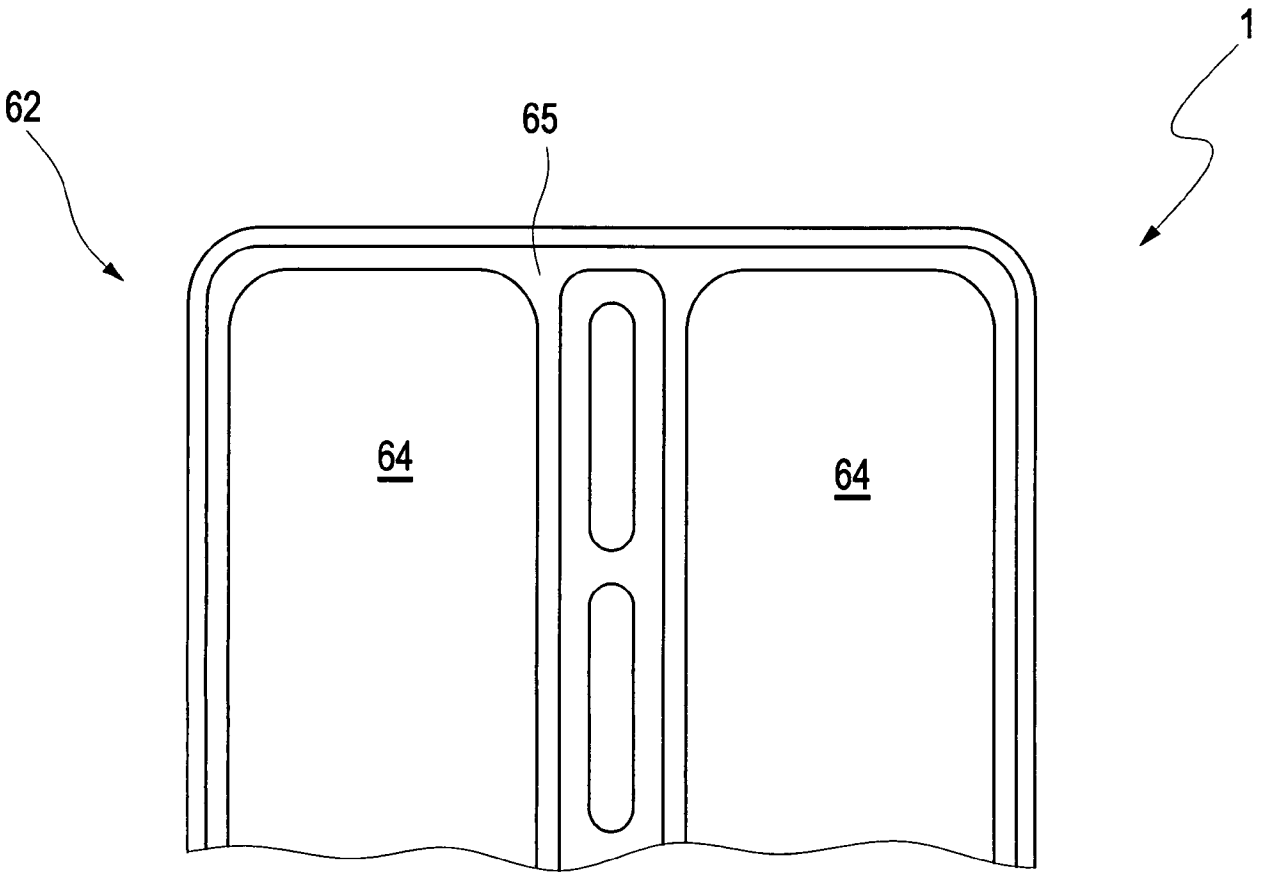
Figure 7A:
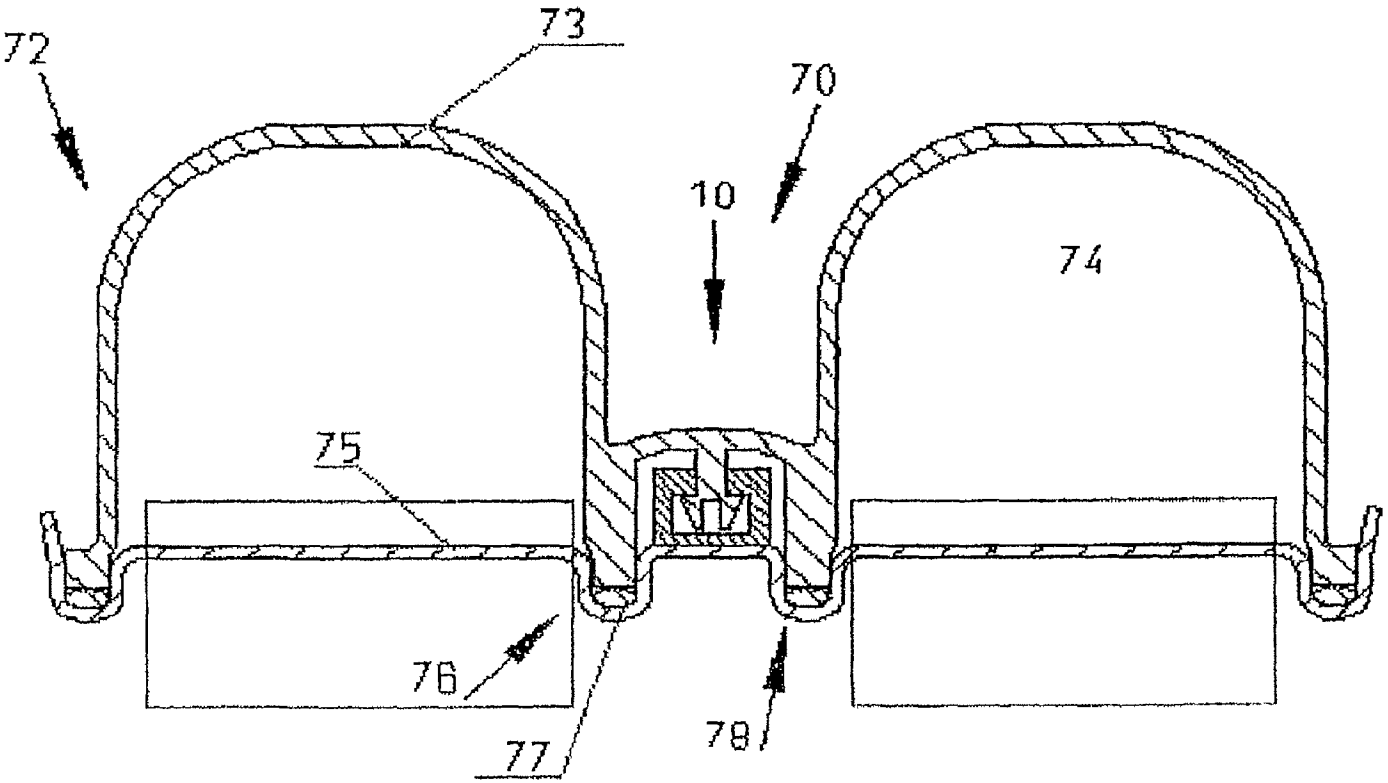
Figure 7B:
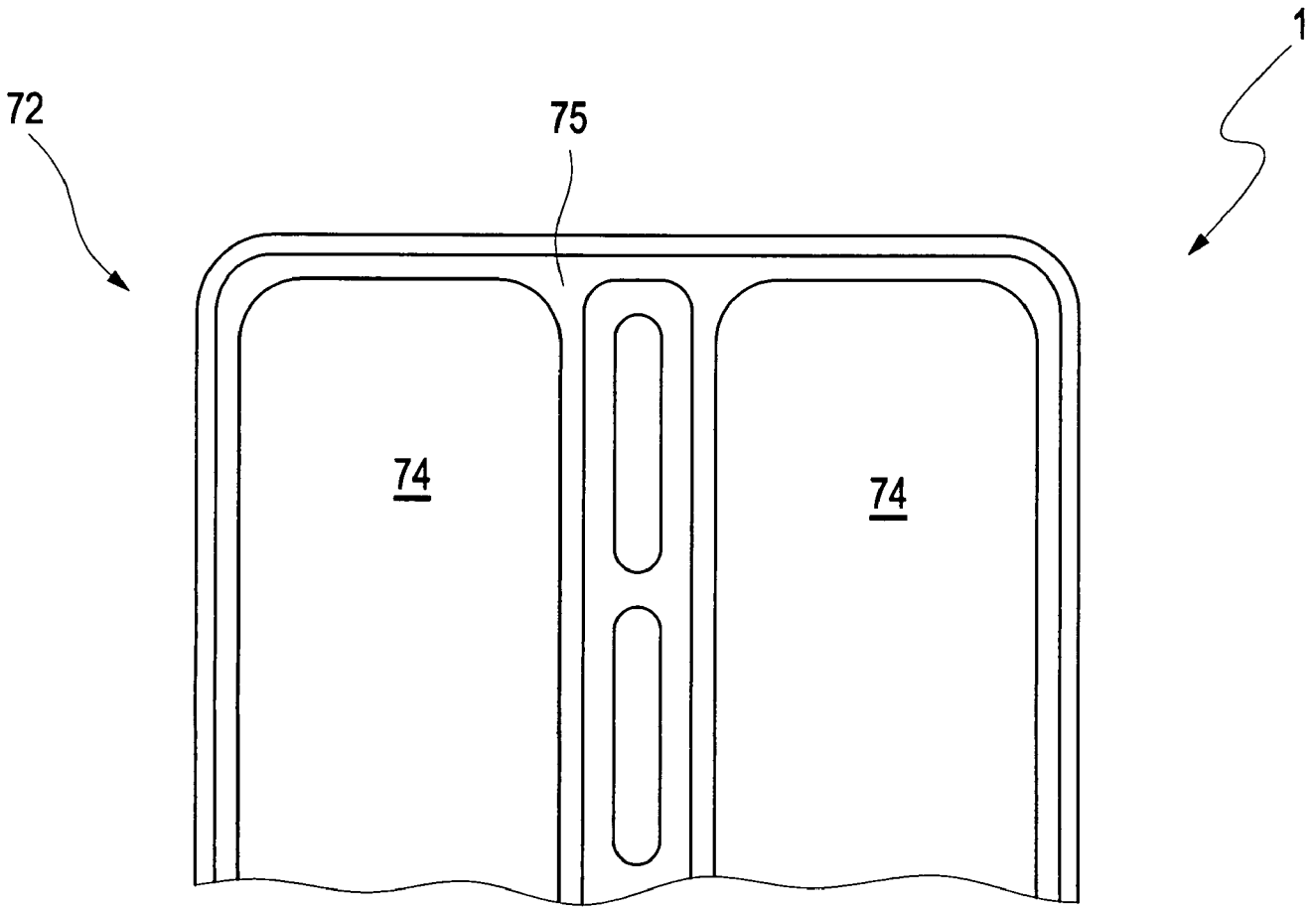
Figure 10:
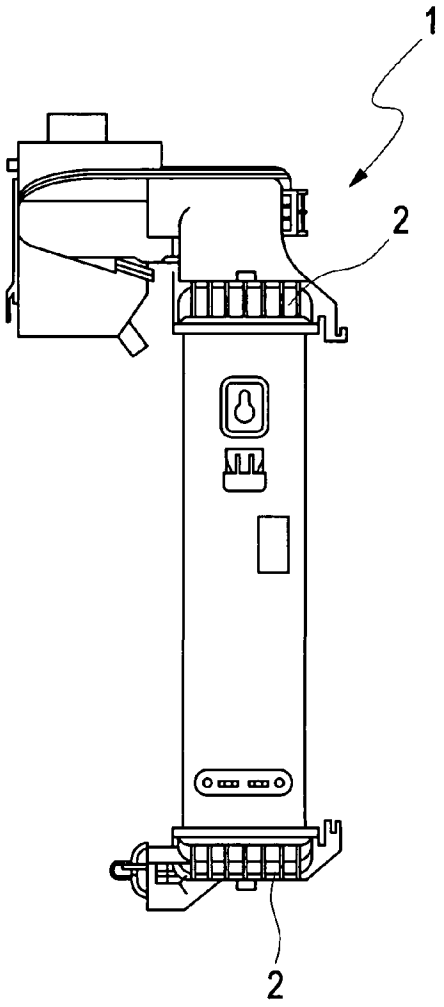
Figure 9:
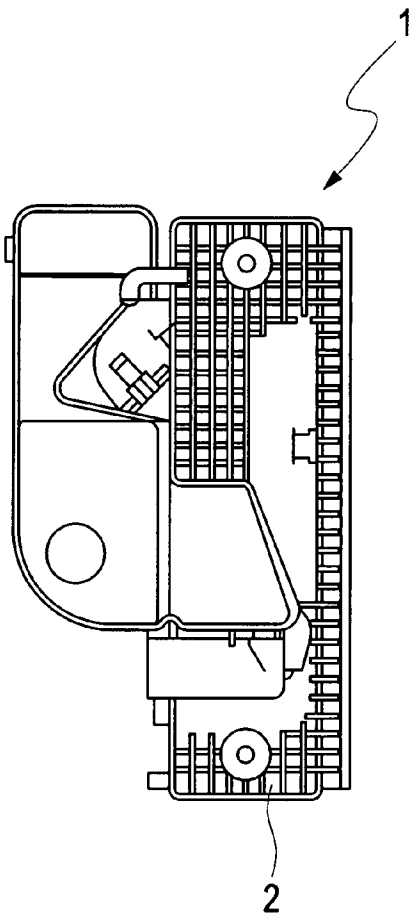
Figure 8:
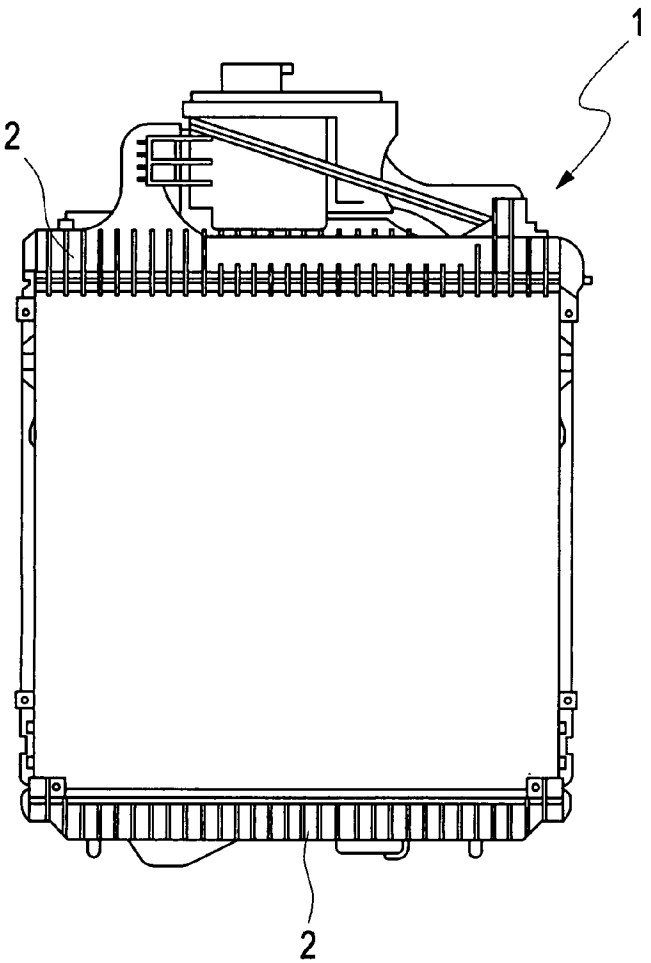

The invention is explained in detail in the following on the basis of a plurality of exemplary embodiments and with reference to the drawing, in which:

FIG. 1 shows a section transversely through a collecting tank according to the first exemplary embodiment, FIG. 2 shows a section transversely through a collecting tank according to the second exemplary embodiment, FIG. 3 shows a section transversely through a collecting tank according to the third exemplary embodiment, FIG. 4 shows a section transversely through a collecting tank according to the fourth exemplary embodiment, FIG. 5 shows a section transversely through a collecting tank according to the fifth FIG. 6*a* shows a section transversely through a collecting tank according to the sixth exemplary embodiment, FIG. 6*b* shows a plan view of part of the base of the collecting tank from FIG. 6*a*, FIG. 7*a* shows a section transversely through a collecting tank according to the seventh exemplary embodiment, FIG. 7*b* shows a plan view of part of the base of the collecting tank from FIG. 7*a*, FIG. 8 shows a view of a cooler having two collecting tanks, FIG. 9 shows a side view of the cooler from FIG. 8, and FIG. 10 shows a plan view of the cooler from FIG. 8.

A motor vehicle cooling system has, as a heat exchanger 1, a two-row cooler having two laterally arranged collecting tanks 2 and having flat tubes (illustrated schematically in the drawing by rectangles) and corrugated fins which run in between said collecting tanks 2, as illustrated in FIGS. 8 to 10. Here, the individual rows of the heat exchanger 1 are part of different circuits, so that the media located in said circuits differ at least in terms of their operating states, for which reason it must be ensured that no leakage takes place between the circuits in the collecting tanks 2.

Each collecting tank 2 is composed of a tank element 3 having two collecting regions 4, which are formed in one piece with one another and hold in each case one medium, and having a substantially planar base 5 which closes off said collecting regions 4. A plurality of openings are formed in two rows in the base 5, said openings substantially corresponding in cross section to the cross section of the flat tubes, which protrude through said openings slightly into the collecting region 4.

To prevent leakage of the collecting regions 4 to the outside, that is to say to the environment, the outer edges of the base 5 are formed corresponding to the drawing in a way known per se, with a slightly elastic sealing element being arranged between the thickened ends of the tank element 3 and the channel-like outer edges of the base 5.

To prevent leakage between the individual collecting regions 4, a sealing arrangement 6 is provided in each collecting tank 2, said sealing arrangement 6 being arranged between the tank element 3 and the base 5 between the collecting regions 4. The sealing arrangement 6 has a slightly elastic sealing element 7 which is compressed by the tank element 3 and the base 5.

Since there is the risk, in particular when there are high pressures in the collecting regions 4, of the collecting tanks 2 being deformed as a result of the high internal pressure, the following measures are implemented to ensure the sealing action between the collecting regions 4:

Firstly, a channel 8 which runs in the longitudinal direction of the sealing arrangement 6 is provided in the substantially plate-shaped base 5, with the sealing element 7 being inserted in said channel 8. The tank element 3 has a projection 9 which extends in the longitudinal direction of said tank element 3 and has an outwardly-directed face which fits at least into the outer region of the channel 8. As a result of the tensile stresses which normally prevail as a result of the fastening of the base 5 to the tank element 3, the sealing element 7 is subject to a compressive stress which is sufficient for most situations.

Secondly, to increase the reliability, a tensile stress generating means 10 is provided adjacent to the sealing arrangement 6; said tensile stress generating means 10 is to be explained in more detail in the following with reference to the individual exemplary embodiments and the associated figures of the drawing. Since the design principle of the collecting tank 2, as described previously, remains unchanged, the reference symbols stated previously are used for all the exemplary embodiments.

FIG. 1 shows a first exemplary embodiment, which relates to a plastic collecting tank 2, in which the tensile stress generating means 10 has a plurality of screws 11 and nuts 12, which interact with said screws 11, arranged in a row. The heads of the screws 11, together with an element 13, which extends in the longitudinal direction parallel to the channel 8 with the screws 11 being inserted into and being rotationally fixedly connected, in the first exemplary embodiment adhered, to said element 13, are fixedly adhered to the base 5 of the collecting tank 2, with the end regions of said screws 11 protruding through openings in the tank element 3. The nuts 12 are arranged on that side of the tank element 3 which faces away from the base 5. In addition, a sealing element 14 is arranged on each screw 11 at that side of the tank element 3 which faces the base, said sealing element 14 projecting into the region of the opening. In addition to providing positioning and additional support of the screws 11, the element 13 also serves as a plane bearing face for the sealing element 14, so that the latter is correctly positioned during installation and is uniformly loaded during operation.

In the region in which the heads of the screws 11 are connected to the base 5, the base 5 has a second channel 15 which runs parallel to the channel 8. Said second channel 15 ensures a good connection which is durable under varying pressures and the associated elastic deformations of the collecting tank 2. In its region between the two collecting regions 4, at least as viewed from the side facing away from the base 5, the tank element 3 is formed so as to be planar and sufficiently wide that the nut 12 can be easily tightened to the required torque. As a result of the nuts 12 of the tensile stress generating means 10 being tightened, the tank element 3 is moved, in its central region and over its entire length, towards the base 5, and is clamped to the latter. The preload acts on the adjacently-running sealing arrangement 6 such that the sealing element 7 is compressed to a greater degree between the tank element 3 and the base 5.

In the second exemplary embodiment illustrated in FIG. 2, the geometric dimensions of the tank element 3 and of the base 5 correspond to those of the first exemplary embodiment, with a second channel 25 in turn being provided, said second channel 25 being formed in the base 5 and extending parallel to the first channel 8. However, in the tensile stress generating means 10 of the second exemplary embodiment, an element 26 which is provided with a plurality of inner threads is adhered in the region of the second channel 25, with screws 27 being screwed into said element 26 through openings in the tank element 3 so that the same function is performed as in the first exemplary embodiment. To provide sealing, sealing elements 24 are in turn provided, said sealing elements 24 corresponding in function to those of the first exemplary embodiment.

In the third exemplary embodiment illustrated in FIG. 3, the geometry of the tank element 3 corresponds to that of the tank element 3 of the first and second exemplary embodiments. However, no second channel is provided in the base 5, so that the latter runs in a substantially planar fashion up to the channel 8, and in principle forms a part of one of the collecting regions 4. An element 33 which extends in the longitudinal direction parallel to the channel 8 is adhered, as in the first exemplary embodiment, to that side of the base 5 which faces the tank, said element 33 comprising a plurality of screws 31 which are inserted through openings in the element 33 and are adhered to the tank element 3. Nuts 32 are screwed onto those ends of the screws 31 which protrude through openings in the tank element 3. Sealing elements 34 are likewise provided, as in the previously described exemplary embodiments, for sealing off the openings.

FIG. 4 shows the fourth exemplary embodiment which corresponds in principle to a combination of the geometry of the third exemplary embodiment with the tensile stress generating means 10 of the second exemplary embodiment. As a result of the second channel being dispensed with, the element 46 which is provided with a plurality of inner threads is formed as a strip, and is adhered by means of one face to that plane face of the base 5 which faces the tank. Screws 47 which are inserted through openings in the tank element 3 are screwed into the element 46. Sealing elements 44 for sealing off the openings are also provided.

In the fifth exemplary embodiment, illustrated in FIG. 5, the geometry of the tank element 3 and of the base 5 corresponds to the previously described third exemplary embodiment. A U shaped element 53 which extends in the longitudinal direction parallel to the channel 8 is adhered, as in the third exemplary embodiment, to that side of the base 5 which faces the tank, said element 53 comprising a plurality of threaded bolts 51 which, with one end, are inserted through openings in the element 53 and are pressed into the element 53. Nuts 52 are screwed onto those ends of the threaded bolts 51 which protrude through openings in the tank element 3. Sealing elements 54 are likewise provided, as in the previously described exemplary embodiments, for sealing off the openings.

FIGS. 6*a*, 6*b*, 7*a*, 7*b* show a sixth and a seventh exemplary embodiment of a collecting tank 62 and 72 respectively, said collecting tank in each case differing in design from the previously described design substantially in that, instead of just one sealing arrangement 6, one sealing arrangement 66 and 76 respectively is arranged at each side of the tensile stress generating means, for which reason the tensile stress generating means 10 is arranged centrally between two collecting regions 64 and 74 respectively, and in that a row of clip-type connections 60 and 70 respectively are used instead of screws or threaded bolts as part of the tensile stress generating means 10, though the use of screws and the like is also possible.

For the sealing arrangements 66 and 76 respectively, in each case two channels 68 and 78 respectively, which run parallel to one another, are provided in the base 65 and 75 respectively, with in each case one sealing element 67 and 77 respectively being placed in said channels 68 and 78 respectively, said sealing element bearing at its other side against a plane face of the tank element 63 and 73 respectively.

In the sixth exemplary embodiment, each clip-type connection 60 is formed by a part which is injection molded into the tank element 63, said part having two spring arms with hook-shaped ends, and an undercut which interacts with said spring arms, said undercut being formed in the base 65 in the form of a plurality of openings formed as slots. Since a certain pressure is exerted during assembly to snap in the clip-type connection 60, the base 65 is pulled in the direction of the tank element 63 at all times, so that sufficient compression of the two parts is ensured in the region of the sealing arrangements 66.

In the seventh exemplary embodiment, the part having the spring arms is formed in one piece with the tank element 73, and corresponds in terms of its shape and mode of operation to that of the sixth exemplary embodiment. In contrast to the sixth exemplary embodiment, a hollow profile which is formed separately from the base 75 is attached to the base 75, with openings in the form of slots in the direction of the tank element 73 being formed in said hollow profile. The hook-shaped ends of the spring arms engage in said openings, and ensure a sufficient preload.

It is obvious that compressive stress generating means, which act correspondingly on the two outer sides of the tank element and the base, can also be provided instead of tensile stress generating means, for which purpose openings which are aligned with one another are provided in particular both in the tank element and in the base, with the compressive stress generating means, for example a screw with a nut, protruding through said openings, with the head of the screw bearing against one outer side and the nut bearing against the other outer side. Both stress generating means can be combined with one another if appropriate.

It is likewise self-evident that, in all of the previously described exemplary embodiments, the arrangement of the openings and of the elements can be exchanged, that is to say the openings can be provided in the base and the elements can be attached to the tank element.

LIST OF REFERENCE SYMBOLS

1 Heat exchanger
2, 62, 72 Collecting tank
3, 63, 73 Tank element
4, 64, 74 Collecting region
5, 65, 75 Base
6, 66, 76 Sealing arrangement
7, 67, 77 Sealing element
8, 68, 78 Channel
9 Projection
10 Tensile stress generating means
11, 31 Screw
12, 32, 52 Nut
13, 33, 53 Element with screws
14, 24, 34, 44, 54 Sealing element
15, 25 Second channel
26, 46 Element with inner threads
27, 47 Screw
51 Threaded bolt
60, 70 Clip-type connection

The invention claimed is:

1. A collecting tank for a heat exchanger of a motor vehicle cooling system, the collecting tank comprising:

a one-piece tank element comprising a first collecting region and a second collecting region, wherein at least one of the first collecting region and the second collecting region comprises a projection;

a base that closes off the first and second collecting regions of the tank element, the base comprising at least one channel;

a sealing element disposed within the at least one channel and separating the first collecting region from the second collecting region; and a stress generating means located adjacent to the channel and clamping at least a portion of the one-piece tank element to the base such that the sealing element is compressed between the projection and the base within the channel, wherein the stress generating means is a means selected from the group consisting of a tensile stress generating means, a compressive stress generating means, and a combination thereof.

2. The collecting tank as claimed in claim 1, wherein the stress generating means comprises a first part and a second part, and comprises at least one threaded connection for adjusting a compression of the sealing element.

3. The collecting tank as claimed in claim 2, wherein:

the first part comprises outer threads and extends through an opening in the tank element or the base, the second part comprises inner threads and is fixedly connected to the base or to the tank element, and the first part is screwed into the second part.

4. The collecting tank as claimed in claim 3, wherein the second part is formed as a strip and has a plurality of openings having the inner threads.

5. The collecting tank as claimed in claim 2, wherein:

the first part is fixedly connected to the base or to the tank element, and extends through the tank element or through the base in a region of an opening, the first part comprising a threaded protruding region, and the second part comprises an inner thread and is screwed onto the threaded protruding region of the first part.

6. The collecting tank as claimed in claim 5, wherein the first part is a screw or threaded bolt, and the collecting tank further comprises a strip that has a plurality of openings in which the screw or threaded bolt is fastened so as to be rotationally fixed.

7. The collecting tank as claimed in claim 1, wherein the stress generating means comprises at least one additional sealing element.

8. The collecting tank as claimed in claim 1, wherein the stress generating means comprises at least one clip-type connection.

9. The collecting tank as claimed in claim 8, wherein one sealing arrangement is provided at each side of the stress generating means.

10. The collecting tank as claimed in claim 1, wherein the tank element or the base comprises at least one resilient arm, said resilient arm engaging in at least one opening in the base or in the tank element.

11. The collecting tank as claimed in claim 10, wherein the at least one opening comprises a plurality of openings, said openings being circular or slot-shaped.

12. The collecting tank as claimed in claim 1, wherein the sealing element comprises a seal selected from the group consisting of a flat seal, a cord seal, and a combination thereof.

13. The collecting tank as claimed in claim 1, wherein the sealing element is of a same type as a sealing element used on an outside of the collecting tank.

14. A collecting tank for a heat exchanger of a motor vehicle cooling system, the collecting tank comprising:

a one-piece tank element comprising a first collecting region and a second collecting region, wherein at least one of the first collecting region and the second collecting region comprises a projection;

a base that closes off the first and second collecting regions of the tank element, the base comprising at least one channel;

a sealing element disposed within the at least one channel and separating the first collecting region from the second collecting region; and a stress generator located adjacent to the channel and clamping at least a portion of the one-piece tank element to the base such that the sealing element is compressed between the projection and the base within the channel, wherein the stress generator is a stress generator selected from the group consisting of a tensile stress generator, a compressive stress generator, and a combination thereof.

15. The collecting tank as claimed in claim 14, wherein the stress generator comprises a first part and a second part, and comprises at least one threaded connection for adjusting a compression of the sealing element.

16. The collecting tank as claimed in claim 15, wherein:

the first part is fixedly connected to the base or to the tank element, and extends through the tank element or through the base in a region of an opening, the first part comprising a threaded protruding region, and the second part comprises an inner thread and is screwed onto the threaded protruding region of the first part.

17. The collecting tank as claimed in claim 14, wherein the stress generator comprises at least one additional sealing element.

18. The collecting tank as claimed in claim 14, wherein the sealing element is of a same type as a sealing element used on an outside of the collecting tank.

* * * * *